United States Patent [19]

Guerrero

[11] 4,126,960

[45] Nov. 28, 1978

[54] DOLL WITH PIVOTABLE HEAD AND PUCKERING LIPS

[75] Inventor: Benjamin G. Guerrero, Los Angeles, Calif.

[73] Assignee: Mattel, Inc., Hawthorne, Calif.

[21] Appl. No.: 761,377

[22] Filed: Jan. 21, 1977

[51] Int. Cl.[2] ..... A63H 5/00

[52] U.S. Cl. ..... 46/118; 46/135 R

[58] Field of Search ..... 46/116, 118, 119, 120, 46/135 R

[56] References Cited

U.S. PATENT DOCUMENTS

| | | | |
|---|---|---|---|
| 2,701,933 | 2/1955 | Pearson | 46/119 |
| 3,494,068 | 2/1970 | Crosman | 46/135 R |

FOREIGN PATENT DOCUMENTS

| | | | |
|---|---|---|---|
| 712,184 | 7/1931 | France | 48/118 |
| 948,367 | 1/1949 | France | 46/118 |
| 1,042,944 | 6/1953 | France | 46/120 |
| 541,785 | 4/1956 | Italy | 46/119 |
| 754,253 | 8/1956 | United Kingdom | 46/118 |

*Primary Examiner*—F. Barry Shay
*Attorney, Agent, or Firm*—John G. Mesaros; Max E. Shirk; Stephen L. King

[57] ABSTRACT

A doll having a compressible torso with a neck opening having support means adjacent to said neck opening with a mechanism coupled to the support means and extending into the torso, compression of the torso in a lateral direction actuating a slide member of the mechanism in a direction generally perpendicular thereto to pivot the head. The slide mechanism is provided with a ramp coacting with lever means adapted to urge against the interior of the head of the doll adjacent the lips to displace the lips outwardly during actuation thereof to simulate kissing. Other means are provided within the doll responsive to actuation of the mechanism to emit an audible sound.

12 Claims, 7 Drawing Figures

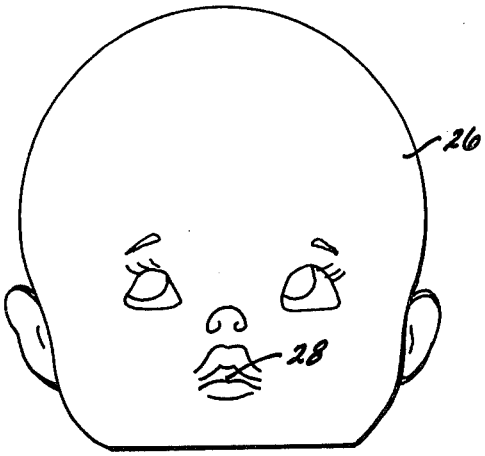
Fig. 4
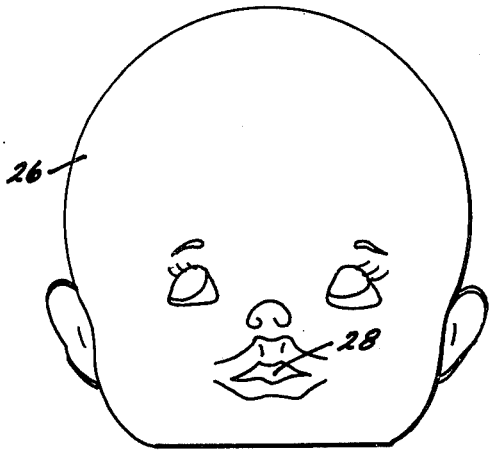
Fig. 5
Fig. 6
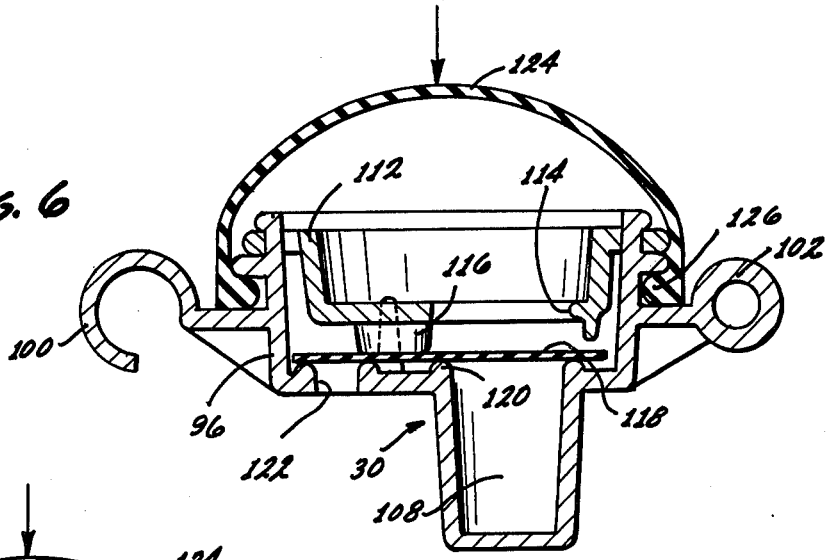
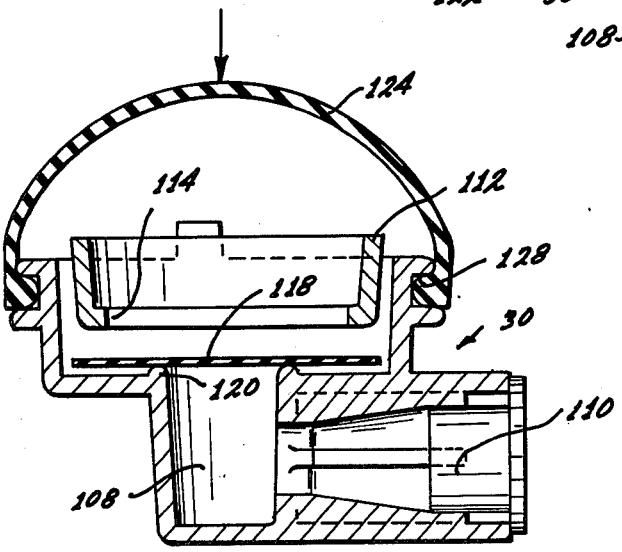
Fig. 7

DOLL WITH PIVOTABLE HEAD AND PUCKERING LIPS

BACKGROUND OF THE INVENTION

The background of the invention will be discussed in two parts:

1. Field of the Invention

This invention relates to pivoting head dolls and more particularly to a novel mechanism for actuating the pivoting in response to manually compressing the torso.

2. Description of the Prior Art

Dolls having some form of animation to simulate the movement of an infant are well known in the prior art. Some forms of animation incorporated in such dolls include pivoting of the head or rocking of the head. Other forms of animation include operating eyes, lips or the like. The mechanisms utilized to accomplish the different types of animation take many forms.

It is an object of this invention to provide a new and unique mechanism for converting compression in a first direction to an output motion normal thereto.

It is another object of this invention to provide a new and improved mechanism for use in a doll.

It is a further object of this invention to provide a new and improved doll having a mechanism operable in response to compression of the torso for pivoting the head thereof, and for simulating a kissing action.

Prior art known to the applicant is listed in a separate communication to the Patent Office by way of illustration and not of limitation.

SUMMARY OF THE INVENTION

The foregoing and other objects of the invention are accomplished by providing a doll having a compressible torso with a neck opening with support means mounted to the torso adjacent the neck opening. A head made of a deformable material is pivotally mounted to the support means. A mechanism is secured to the support means and extends into the interior of the torso, the mechanism having a stationary member and a member slidable with respect to the stationary member, the two members being part of a unitary assembly having an intermediate pressure plate portion actuable upon compression of the doll torso to move the slide member with respect to the stationary member in a direction normal to the applied force. A pivotable lip-engaging lever is mounted on the interior of the doll head and the slideable member is provided with a ramp coacting with the lever to outwardly deform the interior of the doll head adjacent the lips to simulate a kiss or pucker. The free end of the slidable member is coupled in articulated fashion to the interior of the doll head to thereby pivot the doll head in response to actuation of the pressure plate member. The articulation is accomplished through a reed mechanism having a deformable diaphragm or bellows which provides air to the reed mechanism in response to depression of the bellows when contacted by a projection within the doll head with the mechanism actuated.

Other objects, features and advantages of the invention will become apparent upon a reading of the specification when taken in conjunction with the drawings in which like reference numerals refer to like elements in the several views.

BRIEF DESCRIPTION OF THE DRAWINGS

FIG. 4 is a front view of the head of the doll in its normal condition with the mechanism in the position shown in FIG. 1;

FIG. 5 is a front view of the head of the doll with the mechanism in its actuated condition shown in FIG. 3;

FIG. 6 is a cross-sectional side elevation of the bellows-operated reed mechanism taken generally along lines 6—6 of FIG. 2; and FIG. 7 is a cross-sectional view of the bellows-operated reed mechanism taken generally along lines 7—7 of FIG. 2.

DESCRIPTION OF THE PREFERRED EMBODIMENT

Figure 1:
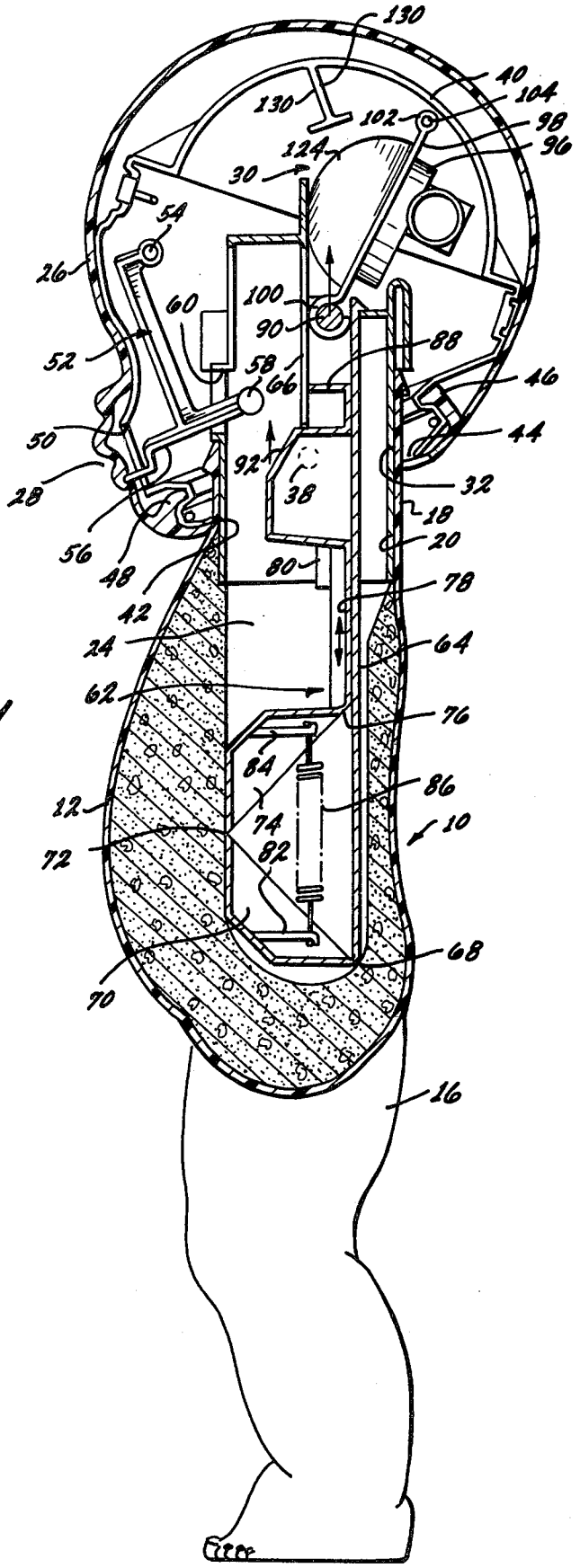
FIG. 1 is a cross-sectional view of a doll taken along a plane extending from front to rear through the longitudinal center line thereof.
Figure 2:
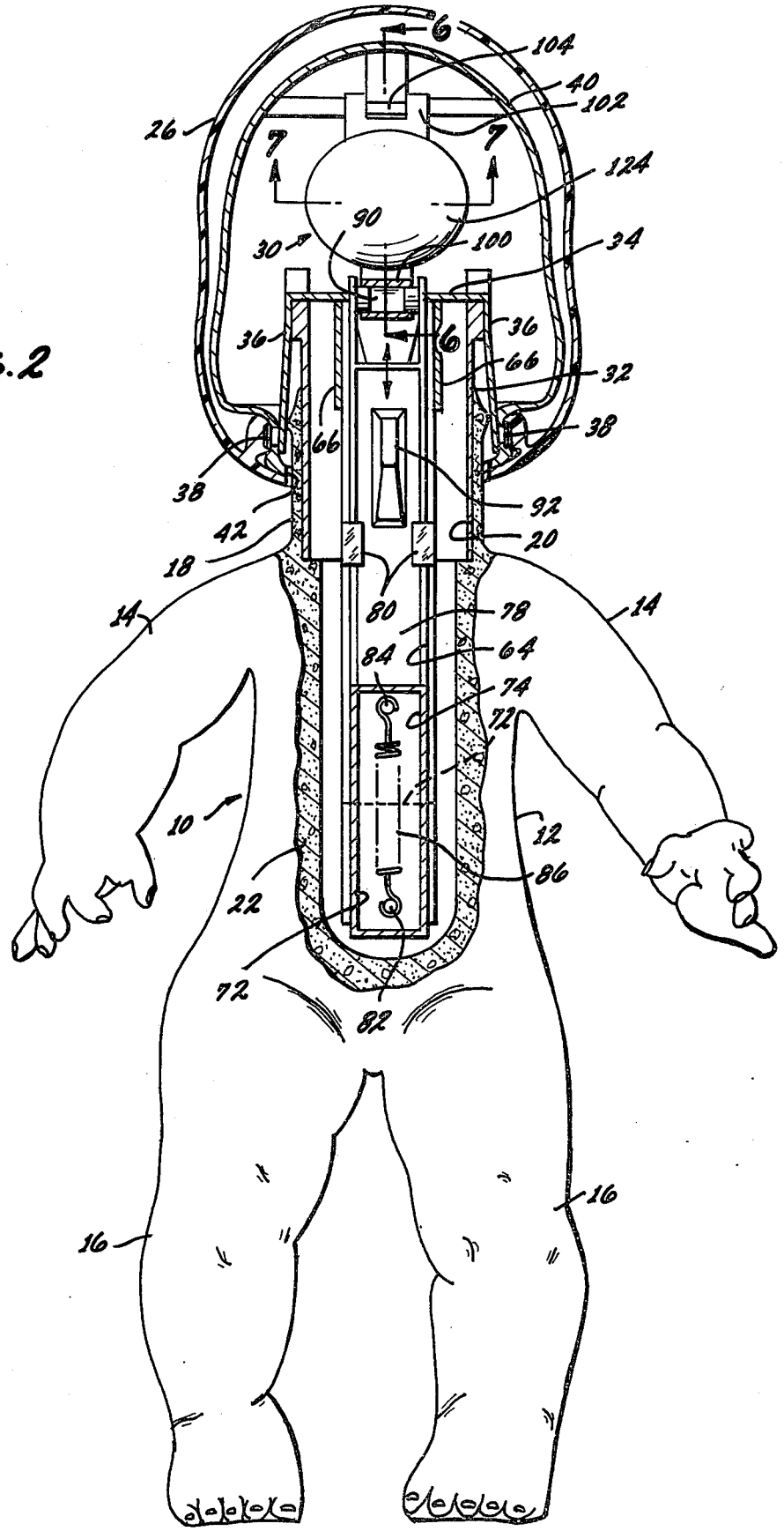
FIG. 2 is a front view of the doll of FIG. 1, partially cut away and partially in cross section showing the head pivoting mechanism.

Referring now to the drawings, and particularly to FIGS. 1 and 2 there is shown a doll having a body generally designated 10 which includes a torso 12, a pair of arms 14 and a pair of legs 16, the doll body 10 being constructed from a one-piece molded part, generally hollow, and made of a flexible vinyl or skin-like material. The doll body 10 has an integral neck portion 18 with a neck opening 20 therein. The interior of the torso 12 is generally filled with a foam-like material 22 suitably secured therein with the central part thereof cutaway to form an elongated opening 24 adapted to receive the mechanism to be hereinafter described. The mechanism, in brief, is intended to pivot the head 26 of the doll in response to compression of the torso 12 while simultaneously moving the lips 28 of the head 26 outwardly to simulate a kissing action while simultaneously actuating a reed mechanism generally designated 30 within the head 26 to simulate a kissing sound.

The neck opening 20 is generally circular and has inserted therein and secured thereto a generally tubular support member 32 which serves to reinforce the area of the neck 18 and to provide means for pivotally supporting the head 26. The lower end of support member 32 is open while the upper end thereof has an inverted cup-shaped member 34 secured thereto, the member 34 having downwardly depending portions 36 diverging outwardly from the surface of support member 32 and having integrally formed therein a pair of aligned pivot pins 38. The downwardly diverging portions 36 extend outside the neck portion 18 and below the upper periphery of the neck opening 20.

The head 26 is of two-piece construction which is hollow and having an outer covering suitably molded from a flexible vinyl or skin-like material. Disposed within this outer covering of head 26 is a skull liner 40, generally following the inner contour of the head 26 but displaced from the flexible covering thereof. The skull liner 40 is formed from a generally rigid plastic material over which the flexible covering is positioned to form the assembly of the head 26. The lower end of head 26 is provided with an opening 42 somewhat larger than the diameter of neck 18 and elongate in form from front to rear to accommodate the pivoting of head 26. The skull liner 40 has a similar opening 44 in alignment with the opening 42 with the lower portion 46 of skull liner 44 being configured to matingly engage an inwardly extending circular shoulder 48 formed on the interior of the flexible covering adjacent the opening 42. The engagement of the shoulder 48 within the recesses of the portion 46 provides frictional retention and alignment of the parts with respect to each other. In proximity to the lips 28 the skull liner 40 is provided with a slot or opening 50. Extending through the slot 50 is a lip actuating lever generally designated 52 which is of an inverted generally T-shaped construction having the stem thereof pivotally secured to a boss 54 formed integrally within skull liner 40. One end 56 of the cross bar extends through slot 50 into abutting relation under the force of gravity with the inner surface of the flexible cover of head 26 adjacent the lips 28, while the other end of the cross bar is configured as a cam follower 58, the cam follower portion 58 extending through a slot 60 formed in the support member 32.

Connected to the inverted cup-shaped member 34 and extending downwardly into the opening 24 along the longitudinal center line of the doll body 10 is a power mechanism which is effectively a linear power producer which converts a small lateral input motion into a linear output motion normal to the input motion. The mechanism, generally designated 62 is a unitary molded part formed from a plastic material and having integral hinge portions to allow the various parts thereof to be realigned to the configuration shown in the drawings. The various parts of the mechanism 62 include a stationary channel member 64 with the channel thereof disposed with the opening part toward the front of the torso 12. The upper end of the channel member 64 has the opposing sidewalls thereof (not shown) enlarged to fit within mating guide portions 66 formed within inverted cup-shaped member 34. The fit is frictional and maintains the channel member 64 in fixed positional relation to the support means provided by the support member 32 and the inverted cup-shaped member 34. At the lower end of channel member 64 there is an integral reduced cross section hinged portion 68 about which is pivoted a first trapezoidal trough member 70, the other end of which is provided with a similar integral reduced cross section hinged portion 72 having a similar second trapezoidal trough member 74 pivotally secured thereto. The trough shaped members 70 and 74 are pivotable with respect to each other on an end-to-end connection with the open portions thereof extending toward the channel member 64 with the sidewalls interconnected by hinged portion 72 being adapted to be in alignment to form a broad pressure plate normally disposed in a plane parallel to the longitudinal center line of the torso 12. Integral with the other end of the trapezoidal trough member 74 is a reduced cross section hinged portion 76 having a slidable member 78 extending upwardly therefrom in sliding relation within the channel of channel member 64 for actuation in the direction of the double-ended arrow shown in FIG. 1.

With the mechanism 62 in its assembled relation within opening 24 the plane of the channel member 64 and the corresponding slidable member 78 is along the line between the arms 14 of the doll body 10. The slidable member 78 is retained in sliding relation within channel member 64 by means of inwardly extending snap detents 80 formed on opposing sidewalls of channel member 64. In the assembled position, the sidewalls of trough members 70 and 74 adjacent the hinges 68 and 76 respectively are in parallel relation and each of the trough members is provided with integral retaining projections 82 and 84 respectively each of which receive opposite ends of a spring member 86 urging the sidewalls toward each other. The spring member 86 is disposed on a line generally parallel to the plane of channel member 64 and normally biases the trough members 70 and 74 to the position shown in FIG. 1.

The uper free end 88 of slide member 78 has a box-like configuration for guiding within the guide means 66 with the upper end thereof having a pivot axis 90 disposed on a line perpendicular to the direction of travel of slide member 78 and parallel to a line through the pivot pins 38 to which the skull liner 40 is pivotally mounted. The direction of pivoting is such as to provide a nodding movement of the head in response to actuation of the mechanism 62 as will be hereinafter described.

Intermediate the end 88 and hinge 76 of slide member 78 the slide member 78 is provided with a perpendicularly extending ramp portion 92, the ramp 92 being adapted to coact with the cam follower 58 of lip lever 52 to urge the inner portion of the flexible covering of head 26 adjacent lips 28 outwardly to simulate a puckering of the lips 28, or to provide a kissing action.

Secured to the pivot axis 90 of slide member 78 in articulated fashion is the reed mechanism 30 which has a main body portion 96 formed of a generally rigid plastic material, the main body portion 96 having a flange 98 having pivot means 100 secured to the pivot axis 90, the other end of flange 98 diametrically opposite from the pivot means 100 being provided with a shaft receiving portion 102 pivotally mounted to a boss 104 formed integrally within skull liner 40. The plane of flange 98 between pivots thereof is disposed at an angle clockwise from the vertical line of travel (as viewed in FIG. 1) of the slide member 78 to thereby urge the skull liner 40 clockwise as slide member 78 moves upwardly in the direction of the arrow indicated through pivot axis 90.

The main body portion 96 of the reed mechanism 30 (see also FIGS. 6 and 7) is generally cup-shaped with an integral downwardly extending plenum portion 108 in fluid communication with a reed mechanism 110. Secured within the main body portion 96 is a second generally cup-shaped member 112 frictionally retained therein and having an aperture 114 in the bottom thereof in communication with plenum 108. The cup-shaped member 112 is provided with a downwardly extending protuberance 116 in close proximity to the bottom of the main body portion 96, the protuberance 116 being configured to abut against and retain in position a circular disc-like diaphragm member 118 which is generally adapted to seal against a circular ridge 120 formed in the bottom of main body portion 96 immediately above plenum 108. An air relief aperture 122 formed in the bottom of main body portion 96 also has diaphragm 118 adapted to engage the upper ridge thereof on the side of protuberance 116 opposite ridge 120. A dome-shaped flexible bellows member 124 has the periphery thereof at 126 enlarged inwardly to frictionally engage a groove 128 formed about the periphery of the open end of main body portion 96.

The reed 110 and the configuration of reed mechanism 30 is intended to emit an audible sound in the nature of a "kissing" sound. Upon depression of the bellows member 124 in the direction indicated by the arrow in FIGS. 6 and 7, the compression of the air urges against the diaphragm 118 to seal the plenum 108 and the air relief aperture 122. As the resilient bellows 124 is permitted to return to its original position, that being shown in FIGS. 6 and 7, air is drawn in through the reed 110 and through the air relief aperture 122, the air seeping in to create a "kissing" sound.

Figure 3:
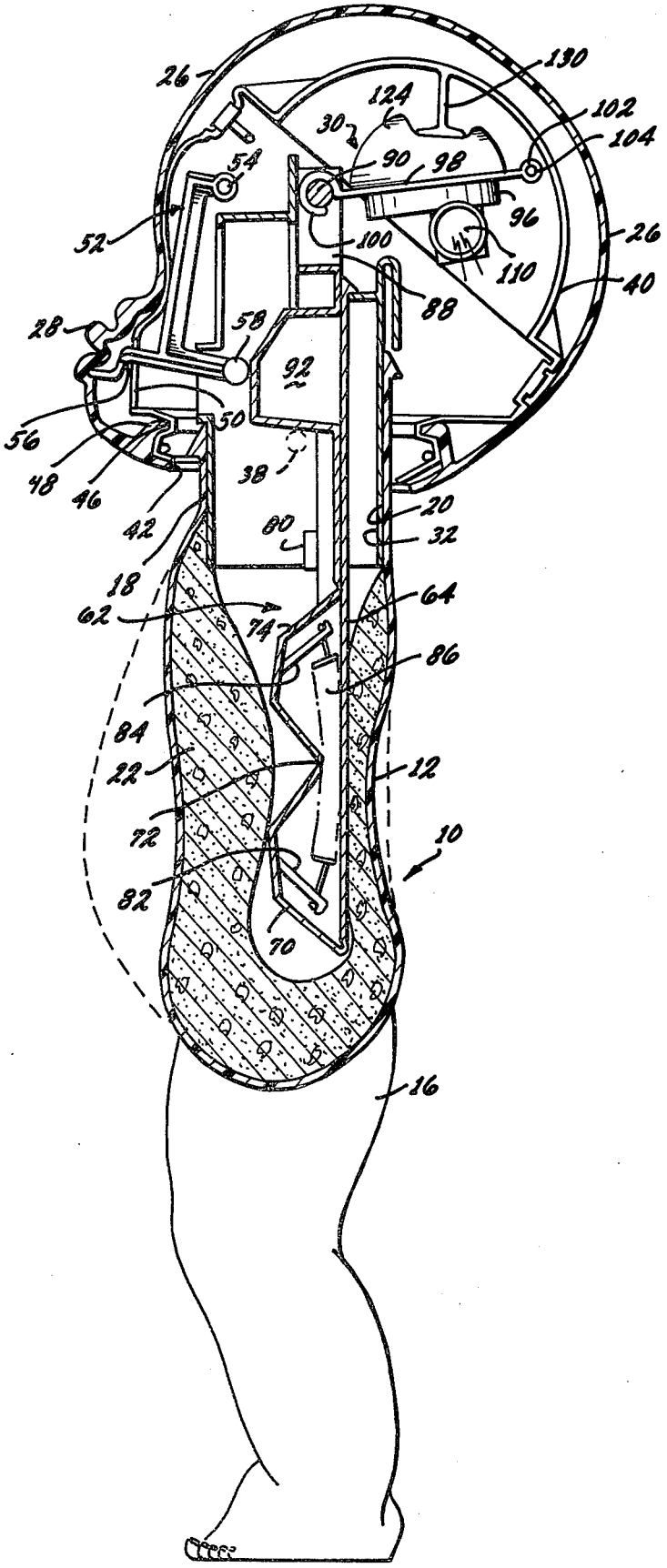
FIG. 3 is a cross-sectional view similar to FIG. 1 showing the head pivoting mechanism in its actuated condition.

In addition to emitting an audible sound, as will now be discussed, prior to operation of the mechanism 62, the head 26 as viewed in FIG. 4 has the lips 28 thereof in closely spaced relation and upon an actuation of the mechanism 62 the lips 28 part as shown in FIG. 5 and by originally sculpturing the lips 28 properly the parting of the lips 28 simulate a kissing action which along with the actuation of the reed mechanism 30 provides a kissing sound to provide audible as well as visual animation. In the normal condition as viewed in FIG. 1 the doll head 26 is resting slightly forward with the lip lever 52 having the lip actuating arm 56 thereof resting against the interior surface of the flexible head covering adjacent lips 28. The trapezoidal trough members 70 74 have the sides thereof interconnected by hinge 72 forming a plane or pressure plate in abutting relation with the foam 22 on the outer surface of opening 24, the foam 22 filling the space between the opening 24 and the outer flexible covering of torso 12. The spring 86 maintains the trapezoidal trough members 70 and 74 with the opposite sidewalls thereof in spaced parallel relation. Slide member 78 is within the channel of channel member 64 with the pivot axis 100 thereof maintaining the reed mechanism 30 in its unactuated condition. As a child grips the doll, usually with both hands, the torso 12 deforms from the dotted line position shown in FIG. 3 to the solid line position to thereby urge against the pressure plate moving hinge 72 inwardly toward channel member 64. This action against the force of spring member 86 urges slide member 78 in abutting sliding relation with channel member 64 upwardly. During this upward movement the ramp 92 engages the cam follower portion 58 of lip lever 52 thereby pivoting lip lever 52 clockwise as viewed in FIG. 3 thereby outwardly deforming and parting lips 28. Simultaneously during this upward movement of slide member 78 the articulated connection of flange 98 thereby causing two things to occur. First, the upward movement of pivot axis 90, through the interconnection with flange 98 to skull liner 40 caused the head 26 to rotate clockwise, the amount of rotation relative to the displacement of the slide member 78 being proportionally less due to the articulation. Secondly, the reed mechanisim 30 is pivoted clockwise with respect to the pivot axis formed by boss 104 until the dome-shaped bellows 124 contacts a stationary inwardly extending broad faced projection 130 on the interior of skull liner 40 which thereby depresses bellows 124 to provide the results hereinabove described with respect to the operation of the reed mechanism 30. The fully actuated position of the mechanism 62 and its effect on the lip lever 52 and the reed mechanism 30 is shown in FIG. 3. When the torso 12 is released the trapezoidal trough members 70 and 74 are pivoted with respect to each other about hinge 72 under the force of the spring member 86 urging the parts together, and upon this release, the "kissing" sound is emitted from the reed mechansim 30 as the lips 28 are permitted to return to the normal position as the cam follower 58 of lip lever 52 goes out of engagement with ramp 92. Consequently, although the mechanism 62 has been illustrated in conjunction with a doll to provide a pivoting head with an animated simulated audible and visual kiss, the mechansim 62 can be utilized in any device in which it is desired to convert a small lateral input motion into a linear output motion normal to the input motion. The mechanism 62 is basically one molded plastic piece with integrally formed unitary hinge portions and a spring member, with the slide member 78 snap fitting into the channel member 64 and retained therein by detent tab 80.

While there has been shown and described a preferred embodiment it is to be understood that various other adaptations and modifications may be made within the spirit and scope of the invention.

What is claimed is:

1. In a doll, the combination comprising:

an at least partially flexible torso having a neck opening and a generally hollow opening within said torso in communication with said neck opening;

a generally rigid tubular support member secured to said torso adjacent said neck opening;

a generally hollow head member having a flexible portion encompassing the lip portion thereof, said head member being pivotally coupled to said support member adjacent said neck opening;

a mechanism including a stationary member secured to said support member and extending into said hollow opening within said torso;

another member slidably coupled to said stationary member and having a portion extending at least partially within said head;

pressure plate means within said hollow opening interconnecting said stationary member and said slidable member for displacing said slidable member relative to said stationary member in reponse to compression of said torso;

means hingedly coupling said portion of said slidable member to the interior of said head for pivoting said head in response to displacement of said slidable member; and other means within said head member coacting with the interior of said head adjacent said lip portion, said other means being operable in response to displacement of said slidable member and to pivoting of said head for urging said lip portion outwardly to cause the lips to simulate a pucker.

2. The combination according to claim 1 wherein said stationary member is an elongate generally bar-shaped member and said another member is a second generally bar-shaped member slidably coupled to said first member.

3. The combination according to claim 2 wherein said pressure plate means has one end thereof hingedly coupled to said stationary member and the other end thereof hingedly coupled to said slidable manner, said pressure plate means being normally biased away from the surface of said first member and operable by a force thereon toward said surface whereby to move said slidable member relative to said stationary member.

4. The combination according to claim 3 wherein said stationary member, said slidable member and said pressure plate means are portions of a unitary plastic member having generally rigid portions connected by integral reduced cross section hinge portions.

5. In a doll, the combination comprising:

an at least partially flexible torso having a neck opening and a generally hollow opening within said torso in communication with said neck opening;

a head having an outer covering of flexible material and an inner generally rigid liner;

support means secured to said torso adjacent the neck opening;

means pivotally connecting said liner to said support means;

a mechanism coupled to said support means, said mechanism including a stationary member and another member slidably coupled to said stationary member with pressure plate means interconnecting said stationary member and said slidable member, said pressure plate means being spring-biased away from said stationary member with compression of said torso moving said pressure plate means against the force of the bias to displace said slidable member relative to said stationary member, said slidable member having a portion thereof extending at least partially within said liner;

means hingedly coupling said portion to the interior of said head for pivoting said head in response to compression of said torso;

a lever member pivotally coupled to said liner, said lever member having an arm engaging the inner surface of said flexible covering adjacent the lips of said doll head; and ramp means on said slideable member for engaging said lever member during movement thereof to urge said flexible cover outwardly to cause the lips to simulate a pucker.

6. The combination according to claim 5 wherein said lever member is an inverted generally T-shaped member having a second arm with a cam follower portion adapted to engage said ramp portion.

7. The combination according to claim 6 wherein said stationary member, said slidable member, said pressure plate means and said ramp means are portions of a unitary generally rigid plastic member having integral reduced cross section hinge portions.

8. The combination according to claim 7 wherein said pressure plate means include a pair of generally trapezoidal trough members hinged end-to-end with the walls thereof adjacent said hinge forming a pressure plate disposed generally parallel to said stationary member.

9. The combination according to claim 8 wherein said stationary member has a channel formed therein and said slidable member is slidably retained within said channel.

10. The combination according to claim 9 wherein said spring-bias is provided by a spring having the opposite ends thereof secured within said trough members.

11. The combination according to claim 10 wherein said portion of said slidable member is hingedly connected to said liner by means of a reed mechanism with a flange portion having one end pivotally connected to said liner and the other end pivotally connected to said portion.

12. The combination according to claim 11 wherein said reed mechanism has a deformable dome-shaped bellows and said liner has an integral broad-faced projection coacting with said bellows upon movement of said slidable member.

* * * * *